US007744239B2

(12) United States Patent
Bono

(10) Patent No.: US 7,744,239 B2
(45) Date of Patent: Jun. 29, 2010

(54) PROTECTION SHIELD AND GRIP FOR FLASHLIGHT

(76) Inventor: Frank M. Bono, 133 Channel Rd. #1, Alpena, MI (US) 49707

( * ) Notice: Subject to any disclaimer, the term of this patent is extended or adjusted under 35 U.S.C. 154(b) by 262 days.

(21) Appl. No.: 12/115,501

(22) Filed: May 5, 2008

(65) Prior Publication Data

US 2008/0278937 A1 Nov. 13, 2008

Related U.S. Application Data

(60) Provisional application No. 60/928,338, filed on May 9, 2007.

(51) Int. Cl.
*F21L 4/04* (2006.01)

(52) U.S. Cl. ..... 362/205; 362/84; 362/202; 362/206; 362/208; 362/376

(58) Field of Classification Search ..... 362/84, 362/202, 205, 206, 208, 376
See application file for complete search history.

(56) References Cited

U.S. PATENT DOCUMENTS 4,415,954 A * 11/1983 Schaefer ..... 362/202
5,795,054 A * 8/1998 Booty, Jr. ..... 362/96
6,769,788 B1 * 8/2004 Kellough ..... 362/208
7,360,921 B1 * 4/2008 Greenspon ..... 362/205

* cited by examiner

*Primary Examiner*—Stephen F Husar
*Assistant Examiner*—James W Cranson
(74) *Attorney, Agent, or Firm*—Weiner & Burt, P.C.; Irving M. Weiner; Pamela S. Burt

(57) ABSTRACT

A thermally-insulating, glow-in-the-dark, protection shield and grip for a flashlight. The shield encircles the switch so that the switch cannot inadvertently be turned ON to discharge the batteries.

20 Claims, 3 Drawing Sheets

FIG 8
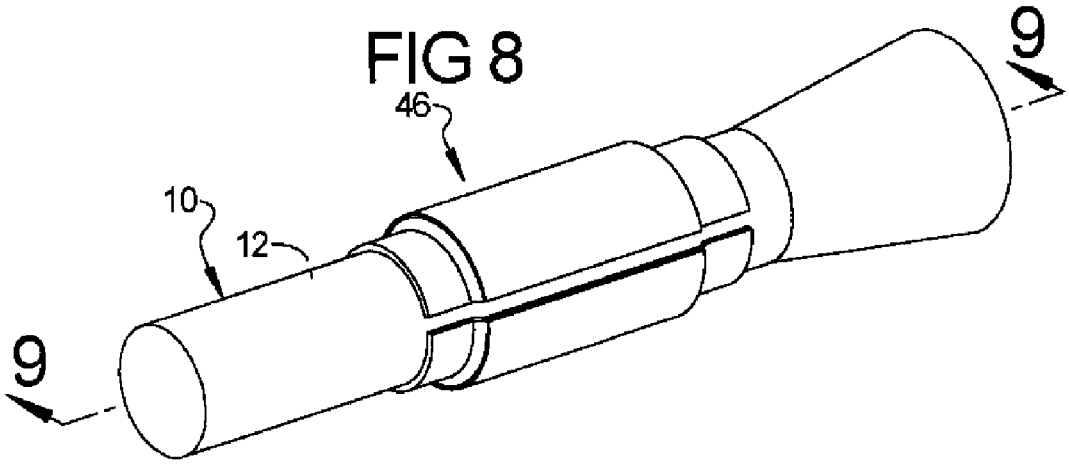
FIG 7
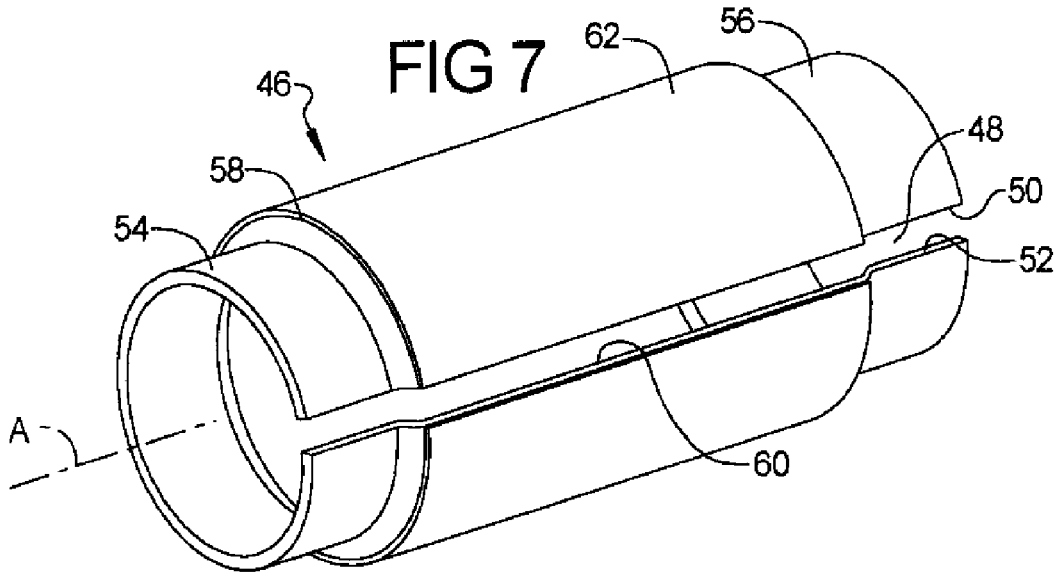
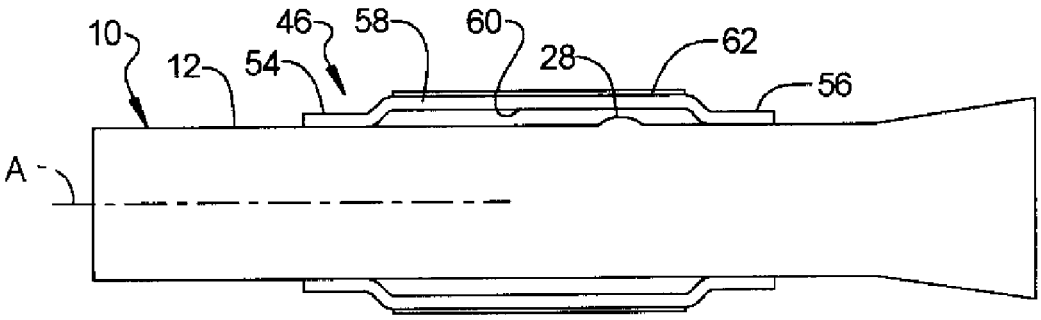
FIG 9

FIG 10
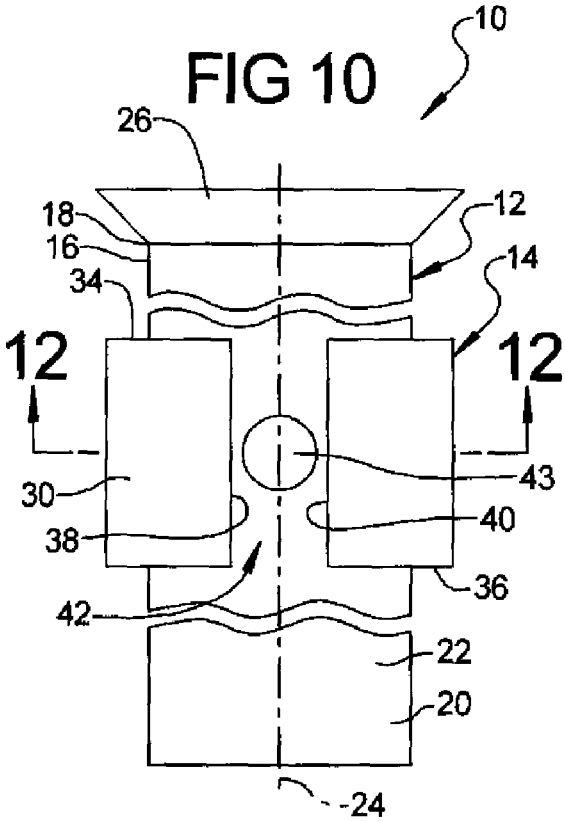
FIG 11
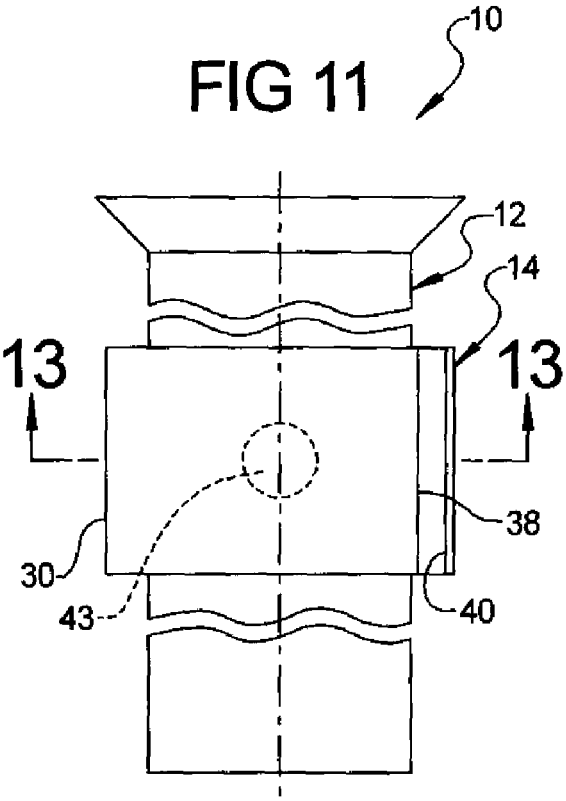
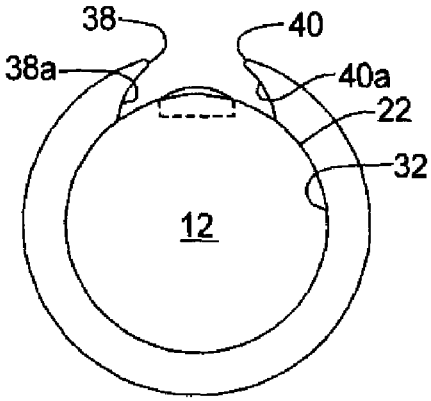
FIG 12
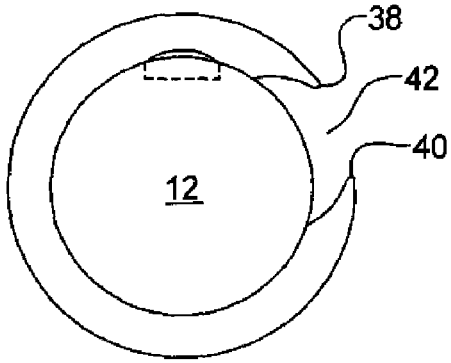
FIG 13

PROTECTION SHIELD AND GRIP FOR FLASHLIGHT

The present application is claims priority from U.S. Provisional Patent Application Ser. No. 60/928,338 filed May 9, 2007.

BACKGROUND OF THE INVENTION

1. Field of the Invention

The present invention pertains to a flashlight with an on/off switch and more particularly to a protection shield for encircling the switch so that the switch cannot inadvertently be turned on and the batteries thereof run down.

2. Description of the Prior Art

Flashlights are known and have been used for many years in many ways. A common conventional flashlight is generally longitudinally elongated, cylindrical, and has a light switch that the user manually presses to turn on the light.

Illustrative of flashlights and arrangements including switch structure are disclosed in the following U.S. Pat. No. 1,688,006 (Duisenberg); U.S. Pat. No. 1,981,213 (Zwierzynski); U.S. Pat. No. 2,569,780 (Berger); U.S. Pat. No. 3,746,818 (Bertelloti); U.S. Pat. No. 3,970,228 (Keller); U.S. Pat. No. 4,034,167 (Boyd); U.S. Pat. No. 4,276,459 (Willett et al); and U.S. Pat. No. 5,795,054 (Booty, Jr.).

Keller discloses a flashlight holder ring.

Duisenberg discloses a flashlight switch guard in the form of a cap guard that snaps into closing fitment with the switch.

While the above patent references are believed to disclose improvements or solutions to problems then presented, desirably a user would like to have a simple inexpensive approach that will prevent the user from inadvertently leaving the light switch on, resulting in the batteries running down.

SUMMARY OF THE INVENTION

The present invention provides a protection shield and grip for a flashlight, comprising, in combination: a flashlight including a handle portion having opposite ends and an outer surface disposed along and around a longitudinal centerline; a light-emitting portion for emitting a light beam therefrom; a switch movably disposed relative to said outer surface and between ON and OFF positions, respectively, of said flashlight; and a protection shield and grip disposed about said outer surface and for rotation between a first position exposing said switch for operation and movement by a user, and a second position covering and shielding said switch.

The present invention discloses a flashlight apparatus comprising: an assembly including a handle portion having opposite ends and an outer surface disposed along a longitudinal centerline, a light-emitting portion for emitting a directional light beam, and a switch movably disposed relative to the outer surface and between on and off positions, respectively, of the light, and a protective shield disposed about the outer surface and for rotation between first and second positions, wherein the switch is exposed and available for use in operating the light and covered and shielded from further use.

According to an aspect of this invention, when in the second position, the shield protectively encloses the switch, and depending on the desired application, prevents further operation of the switch. As such, the switch can be inhibited from inadvertently being operated, or, maintained in the on position, if so desired.

According to this embodiment, the shield comprises a split cylindrical sleeve adapted to fit about and rotate relative to the outer surface of the handle portion and the switch, the sleeve being resiliently radially expandible and contractible, wherein to engage the outer surface of the handle portion and maintain the sleeve in a desired first position relative to the switch and the switch is exposed for use, and to yield to external manual force and rotate into a second position wherein to cover and inhibit inadvertent use of the switch. In an aspect, the sleeve may be comprised of a resilient polymer which glows in darkness, and thermally insulates the user's hand from hot and cold temperatures.

In an aspect, the split cylindrical sleeve has an inner surface complementary to the outer surface of the handle portion, opposite longitudinal end faces, and a pair of radial end faces disposed in faced relation that move towards and away from one another, the end faces defining a longitudinal gap that is registered with the switch when the sleeve is rotated into the first position.

Depending on the application, the switch is capable of being moved longitudinally, and termed a slide switch, or radially up and down (i.e., radially towards and away from the central longitudinal axis).

Preferably, the inner surface proximate to at least one, or both end faces, is provided with a taper, the tapered surface providing a cam surface to enable rotation of the sleeve over and atop the switch.

In some applications, the inner surface of the sleeve is formed to include at least one recess that opens on one of the two radial end faces, the recess being sized to protectively receive and fit about the switch upon rotation of the sleeve, the recess extending angularly inwardly and away from the radial end face to an rearward abutment endwall that limits rotation of the shield relative to the handle portion.

In some applications a like shaped recess extends from each radial end face, enabling the shield sleeve to be rotated in either direction.

According to another embodiment, a shield for protecting the light switch of a flashlight of the type including a generally cylindrical handle portion having an outer surface, a light, and a switch disposed on the outer surface for operating the light, comprises a generally hollow cylindrical split sleeve that is resilient and radially expansible and contractible, the sleeve having an inner surface, opposite end faces, and a pair of radial faces, the radial faces being in spaced relation to one another and forming a gap that extends longitudinally between the end faces, and the inner surface having a diameter less than the diameter of the outer surface wherein the sleeve forms a frictional non-moving engagement with the outer surface yet yields to an external torque to rotate between a first position wherein the sleeve covers the switch and a second position wherein the switch is disposed in the gap and for positioned for operable use.

The present invention will be more clearly understood with reference to the accompanying drawings and to the following Detailed Description, in which like reference numerals refer to like parts.

BRIEF DESCRIPTION OF THE DRAWINGS

FIGS. 7-9 illustrate an alternate preferred embodiment of a switch protection sleeve according to this invention and shown, respectively, in perspective, in perspective and when mounted in covering relation about a flashlight switch, and in a side elevation view taken along line 9-9 of FIG. 8.

FIGS. 10 and 11 are side views of a flashlight assembly, according to the present invention, between a flashlight and switch protection sleeve, respectively, wherein the sleeve is in one of two positions and a flashlight push button switch is exposed for use and protectively covered and the use thereof inhibited.

FIG. 12 is a view taken along line 12-12 of FIG. 10 illustrating the protection sleeve in fitted relation to the flashlight and the switch exposed for use.

FIG. 13 is a view taken along line 13-13 of FIG. 11 illustrating the protection sleeve in covering relation with the flashlight switch.

DETAILED DESCRIPTION OF THE INVENTION

Figure 1:
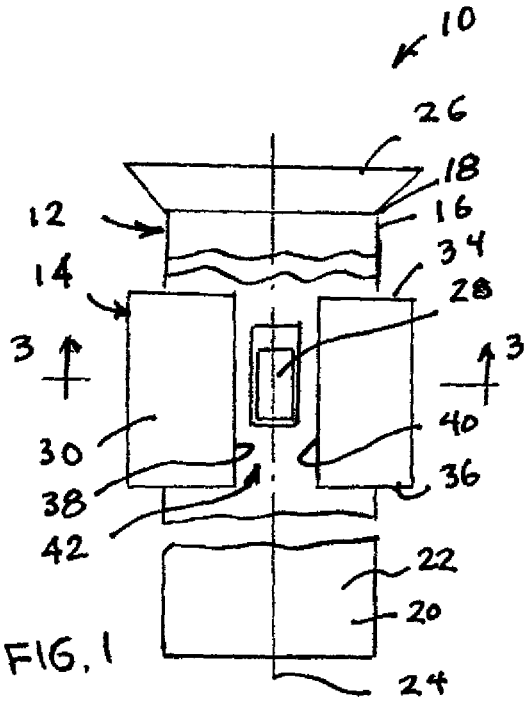
FIGS. 1 and 2 are side views of a flashlight assembly, according to the present invention, between a flashlight and switch protection sleeve, respectively, wherein the sleeve is in one of two positions and a flashlight switch is exposed for use and protectively covered and the use thereof inhibited.

Referring now to the drawings and particularly to FIG. 1, according to the present invention, a flashlight apparatus, generally indicated by the number 10, comprises a conventional flashlight 12 and a protective shield 14 for protecting and exposing the switch of the flashlight. The assembly of protective shield 14 and flashlight 12 essentially requires only that the protective shield have a diameter that enables frictional fitment thereof about and with the outer surface of the conventional flashlight.

The flashlight 12 is longitudinally elongated and generally cylindrical and includes a handle portion 16 having opposite forward and rearward ends 18 and 20 and a generally cylindrical outer surface 22 disposed along a longitudinal centerline 24, a light-emitting portion 26 at the forward end 18 for emitting a directional light beam, and a switch 28 movably disposed relative to the outer surface and between on and off positions, respectively, of the light. The light 26, the switch 28, and the circuitry for connecting the switch to the light are conventional and will not be described in detail herein.

Depending on the particular flashlight, the switch 28 is capable of being moved longitudinally back and forth, and termed a slide switch, or radially up and down (i.e., radially towards and away from the central longitudinal axis). Further, depending on the flashlight 12, the slide switch may be disposed within a recess in the outer surface 22 and, at least in part, be below the outer surface or project upwardly from the outer surface. In some flashlights, the switch may be within a recess and the top surface thereof coextensive with the outer surface of the flashlight. In all of these arrangements, the shield 14 should cover the switch.

Figure 2:
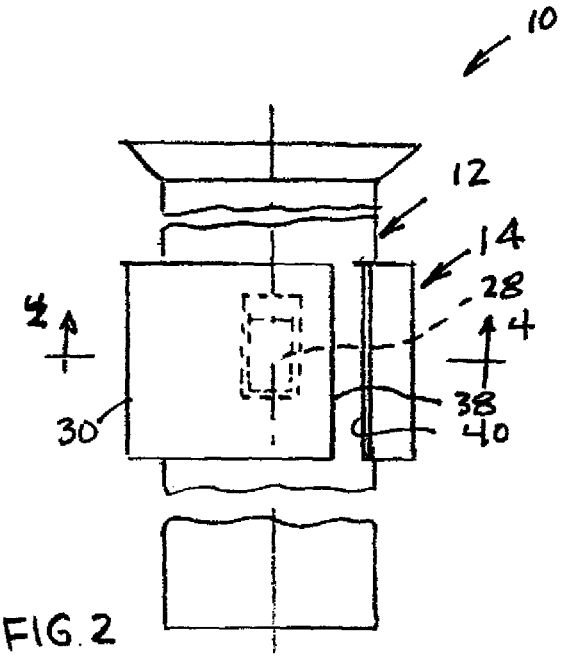

In the embodiment illustrated in FIGS. 1 and 2, the switch 28 is a slide switch that extends, at least in part, upwardly from the outer surface 22 of the handle portion 16. To actuate the light 26, the switch 28 is moved longitudinally between the opposite ends 18 and 20 of the handle portion 16.

The protective shield 14 is disposed about the outer surface 22 and for rotation between a first position (FIGS. 1 and 3), wherein the switch 28 is exposed and available for use in operating the light, and a second position (FIGS. 2 and 4), wherein the switch is covered and shielded from further use.

When in the second position, the protective shield 14 protectively covers and/or encloses the switch 28. Depending on the desired application, the shield 14 prevents further operation of the switch. That is, when the shield 14 is in covering relation with the switch 28, the switch can be inhibited from inadvertently being operated and the light maintained in an off position, or if so desired, maintained in the on position.

According to this embodiment, the shield 14 comprises a split cylindrical sleeve 30 adapted to fit about and rotate relative to the outer surface of the handle portion and the switch 28. The sleeve 30 has a cylindrical inner surface 32 that is complementary to the outer surface 22 of the handle portion 16, opposite longitudinal end faces 34 and 36, and a pair of radial end faces 38 and 40 disposed in faced relation with one another. The inner surface 32 is complementary to the outer surface 22 of the handle portion 16. The radial end faces 38 and 40 form a longitudinal gap 42.

The sleeve 30 is dimensioned to circumscribe at least a portion of the flashlight body 16. Preferably, the sleeve 30 encircles the flashlight body by an amount that the switch 28 is snugly nested in the gap 42 and between the end faces 38 and 40. As illustrated, the cover 30 encircles approximately 340°-350° of the flashlight 12 when viewed in cross-section.

The sleeve 30 is comprised of a material that is resilient and enables the sleeve to radially expand and contract (i.e., temporarily open or flex and be pressed radially inward). The diameter of the inner surface 32 of the sleeve 30 is somewhat smaller than the diameter of the outer surface 22 of the handle portion 16 wherein the inner surface 32 will normally be forced into circumferential gripping relation with the outer surface 22 of the handle portion.

Preferably, the sleeve 30 is manufactured from a self supportive but flexible plastic which is durable and resistant to environmental factors of rain, extreme temperatures and sunlight. Exemplary materials include polystyrene, polyethylene, polypropylene, PVC or equivalent materials to which has been added phosphorescent or glow material that emit light in darkness and will glow for 4 to 16 hours.

Figure 3:
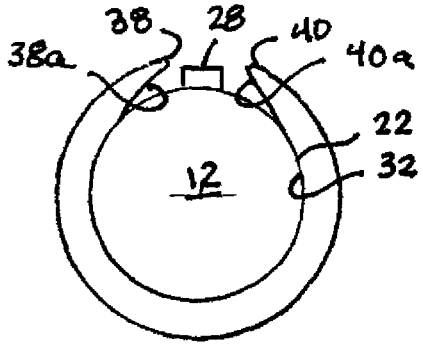
FIG. 3 is a view taken along line 3-3 of FIG. 1 illustrating the protection sleeve in fitted relation to the flashlight and the switch exposed for use.
Figure 4:
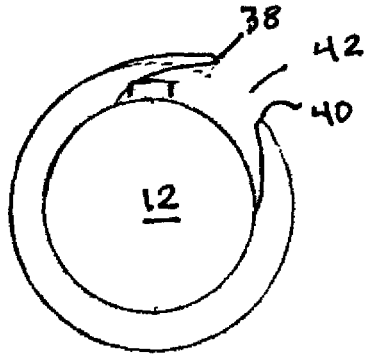
FIG. 4 is a view taken along line 4-4 of FIG. 2 illustrating the protection sleeve in covering relation with the flashlight switch.

As illustrated in FIGS. 1 and 3, and then in FIGS. 2 and 4, the resilience of the material enables the sleeve 30 to be maintained in the first position, wherein the switch 28 is not covered but in the gap 42, and maintained in the second position, wherein the switch 28 is covered by the sleeve. The end faces 38 and 40 are resiliently biased towards one another but the sleeve 30 will yield to external manual torque or rotational forces applied thereto, whereupon the end faces 38 and 40 and the surfaces 22 and 32 will separate slightly and enable the sleeve to rotate into a new position relative to the handle portion 16.

In an aspect, as the inner surface of the sleeve proximate to the end faces 38 and 40 has a taper 38*a* and 40*a* wherein to form a cam surface to slide upwardly and atop the switch 28 upon rotation of the sleeve 30.

Figure 5:
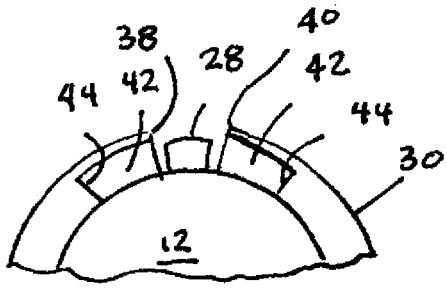
FIGS. 5 and 6 are views similar to FIGS. 3 and 4 and illustrate an alternate preferred embodiment of a switch protection sleeve according to this invention, the sleeve having at least one recess for receiving the flashlight switch.
Figure 6:
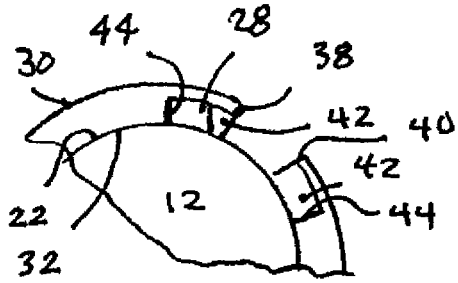

Referring to FIGS. 5 and 6, in some applications, the inner surface 22 of the sleeve 30 is formed to include at least one recess 42. The recess 42 has a longitudinal extension that is coextensive with the switch 28 to be protectively covered and opens on and extends angularly from a radial end face 38 and 40 to a rearward abutment endwall 44. The recess 42 is generally rectangular and sized to protectively receive and fit about the switch 28. The endwall 44 provides a limit on the rotation of the shield 14 relative to the handle portion 16.

In some applications a like shaped recess 42 extends from each radial end face, enabling the shield sleeve 30 to be rotated in either direction.

Referring now to FIGS. 7-9, the reference number 46 indicates another preferred embodiment of a protective shield or sleeve according to this invention. Referring to FIG. 7, the sleeve 46 is stepped and generally cylindrical and longitudinally split to form a gap 48, forming a pair of circumferentially spaced sidewalls 50 and 52. Further, the sleeve 46 includes cylindrical forward and rearward end sections 54 and 56 and a cylindrical central section 58 that extends between the end sections 54 and 56, each of the sections 54, 56 and 58 being generally coaxially centered with the geometric axis of the sleeve. The sleeve is dimensioned such that the end sections 54 and 56 thereof frictionally engage the outer surface 12 of the flashlight 10, in a manner described hereinabove.

Further, according to this embodiment of the invention, the central section 58 has a diameter greater than that of the end sections and forms an annular recess 60 that extends between the sidewalls 50 and 52. Importantly, the annular recess 60 is dimensioned to encircle the switch 28 of the flashlight.

Additionally, the outer surface of the sleeve is preferably provided with a surface that enables the user to rotate the sleeve, and or mount and remove the sleeve from the flashlight. Preferably, as shown in FIG. 7, a suitable elastomer, indicated at 62, is molded onto the exterior surface of the central section 58. In some applications, the outer surface of the central section may be provided with ribs or otherwise roughened, wherein the sleeve 46 may be gripped and positioned as desired.

In FIG. 8, the sleeve 46 is shown mounted to the flashlight, and angularly positioned such that the switch 28 is protectively covered. The sleeve, so positioned, prevents the switch from being turned on when the flashlight is not in use. If operation is desired, the user would grip the elastomer 62, and rotate the sleeve 46 relative to the flashlight, until gap 48 is rotated into register with the switch 28.

FIG. 9 is a side view showing the switch 28 protectively encircled and enclosed within the annular recess 60.

FIGS. 10-13 depict an embodiment of the invention wherein the flashlight 12 has a push button switch 43 which is almost level with the outer surface 22 of the flashlight 12, and wherein the sleeve/shield 14 is provided with a gap 42 but is not provided with a cut out or abutments endwalls 44 for the switch 43.

The invention has been described with reference to various preferred embodiments. Modifications and alterations will occur to others upon reading and understanding the present patent application. The invention is intended to include all such modifications and alterations insofar as they come within the scope of the appended claims and the equivalents thereof.

The invention claimed is:

1. A protection shield and grip for a flashlight, comprising, in combination:

a flashlight including a handle portion having opposite ends and an outer surface disposed along and around a longitudinal centerline;

a light-emitting portion for emitting a light beam therefrom;

a switch movably disposed relative to said outer surface and between ON and OFF positions, respectively, of said flashlight; and a protection shield and grip disposed about said outer surface and for rotation between a first position exposing said switch for operation and movement by a user, and a second position covering and shielding said switch.

2. A protection shield and grip according to claim 1, wherein:

said shield and grip includes at least a portion thereof which glows in darkness.

3. A protection shield and grip according to claim 1, wherein:

said shield and grip is fabricated from a material which glows in darkness.

4. A protection shield and grip according to claim 2, wherein:

said shield and grip is fabricated from a material which glows in darkness.

5. A protection shield and grip according to claim 1, wherein:

said shield and grip comprises a generally hollow cylindrical split sleeve which is resilient and radially expansible and contractible.

6. A protection shield and grip according to claim 2, wherein:

said shield and grip comprises a generally hollow cylindrical split sleeve which is resilient and radially expansible and contractible.

7. A protection shield and grip according to claim 3, wherein:

said shield and grip comprises a generally hollow cylindrical split sleeve which is resilient and radially expansible and contractible.

8. A protection shield and grip according to claim 4, wherein:

said shield and grip comprises a generally hollow cylindrical split sleeve which is resilient and radially expansible and contractible.

9. A protection shield and grip according to claim 1, wherein:

said shield and grip comprises an inner surface and an outer surface, opposite end faces, and a pair of switch-engaging faces;

said switch-engaging faces being in spaced relation to one another and forming a gap which extends longitudinally between said end faces; and said inner surface having a diameter less than said outer surface of said flashlight wherein said sleeve is in frictional non-moving engagement with said outer surface of said flashlight yet yields to an external torque applied by the user to rotate said shield between said first position wherein said switch is disposed in said gap for operation by the user, and said second position covering said switch.

10. A protection shield and grip according to claim 2, wherein:

said shield and grip comprises an inner surface and an outer surface, opposite end faces, and a pair of switch-engaging faces;

said switch-engaging faces being in spaced relation to one another and forming a gap which extends longitudinally between said end faces; and said inner surface having a diameter less than said outer surface of said flashlight wherein said sleeve is in frictional non-moving engagement with said outer surface of said flashlight yet yields to an external torque applied by the user to rotate said shield between said first position wherein said switch is disposed in said gap for operation by the user, and said second position covering said switch.

11. A protection shield and grip according to claim 3, wherein:

said shield and grip comprises an inner surface and an outer surface, opposite end faces, and a pair of switch-engaging faces;

said switch-engaging faces being in spaced relation to one another and forming a gap which extends longitudinally between said end faces; and said inner surface having a diameter less than said outer surface of said flashlight wherein said sleeve is in frictional non-moving engagement with said outer surface of said flashlight yet yields to an external torque applied by the user to rotate said shield between said first position wherein said switch is disposed in said gap for operation by the user, and said second position covering said switch.

12. A protection shield and grip according to claim 4, wherein:

said shield and grip comprises an inner surface and an outer surface, opposite end faces, and a pair of switch-engaging faces;

said switch-engaging faces being in spaced relation to one another and forming a gap which extends longitudinally between said end faces; and said inner surface having a diameter less than said outer surface of said flashlight wherein said sleeve is in frictional non-moving engagement with said outer surface of said flashlight yet yields to an external torque applied by the user to rotate said shield between said first position wherein said switch is disposed in said gap for operation by the user, and said second position covering said switch.

13. A protection shield and grip according to claim 5, wherein:

said shield and grip comprises an inner surface and an outer surface, opposite end faces, and a pair of switch-engaging faces;

said switch-engaging faces being in spaced relation to one another and forming a gap which extends longitudinally between said end faces; and said inner surface having a diameter less than said outer surface of said flashlight wherein said sleeve is in frictional non-moving engagement with said outer surface of said flashlight yet yields to an external torque applied by the user to rotate said shield between said first position wherein said switch is disposed in said gap for operation by the user, and said second position covering said switch.

14. A protection shield and grip according to claim 6, wherein:

said shield and grip comprises an inner surface and an outer surface, opposite end faces, and a pair of switch-engaging faces;

said switch-engaging faces being in spaced relation to one another and forming a gap which extends longitudinally between said end faces; and said inner surface having a diameter less than said outer surface of said flashlight wherein said sleeve is in frictional non-moving engagement with said outer surface of said flashlight yet yields to an external torque applied by the user to rotate said shield between said first position wherein said switch is disposed in said gap for operation by the user, and said second position covering said switch.

15. A protection shield and grip according to claim 7, wherein:

said shield and grip comprises an inner surface and an outer surface, opposite end faces, and a pair of switch-engaging faces;

said switch-engaging faces being in spaced relation to one another and forming a gap which extends longitudinally between said end faces; and said inner surface having a diameter less than said outer surface of said flashlight wherein said sleeve is in frictional non-moving engagement with said outer surface of said flashlight yet yields to an external torque applied by the user to rotate said shield between said first position wherein said switch is disposed in said gap for operation by the user, and said second position covering said switch.

16. A protection shield and grip according to claim 8, wherein:

said shield and grip comprises an inner surface and an outer surface, opposite end faces, and a pair of switch-engaging faces;

said switch-engaging faces being in spaced relation to one another and forming a gap which extends longitudinally between said end faces; and said inner surface having a diameter less than said outer surface of said flashlight wherein said sleeve is in frictional non-moving engagement with said outer surface of said flashlight yet yields to an external torque applied by the user to rotate said shield between said first position wherein said switch is disposed in said gap for operation by the user, and said second position covering said switch.

17. A protection shield and grip according to claim 1, wherein:

said shield and grip is fabricated from a material which thermally insulates a hand of the user from hot and cold temperatures.

18. A protection shield and grip according to claim 9, wherein:

said shield and grip is fabricated from a material which thermally insulates a hand of the user from hot and cold temperatures.

19. A protection shield and grip according to claim 10, wherein:

said shield and grip is fabricated from a material which thermally insulates a hand of the user from hot and cold temperatures.

20. A protection shield and grip according to claim 16, wherein:

said shield and grip is fabricated from a material which thermally insulates a hand of the user from hot and cold temperatures.

* * * * *